US007233760B2

(12) United States Patent
Buchanan

(10) Patent No.: US 7,233,760 B2
(45) Date of Patent: Jun. 19, 2007

(54) METHOD AND DEVICE FOR DOCTOR BLADE RETENTION

(75) Inventor: John Andrew Buchanan, Paris, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 11/010,495

(22) Filed: Dec. 13, 2004

(65) Prior Publication Data

US 2006/0127137 A1 Jun. 15, 2006

(51) Int. Cl.
*G03G 15/08* (2006.01)

(52) U.S. Cl. ..... 399/284

(58) Field of Classification Search ..... 399/284, 399/274

See application file for complete search history.

(56) References Cited

U.S. PATENT DOCUMENTS

| | | | | |
|---|---|---|---|---|
| 5,070,783 | A | 12/1991 | Ireton | 101/349 |
| 5,085,171 | A | 2/1992 | Aulick et al. | 118/653 |
| 5,232,500 | A * | 8/1993 | Kamaji et al. | 118/261 |
| 5,278,616 | A * | 1/1994 | Hirano et al. | 399/279 |
| 5,337,032 | A | 8/1994 | Baker et al. | 355/260 |
| 5,623,718 | A | 4/1997 | Bracken et al. | 399/284 |
| 5,702,812 | A | 12/1997 | Bracken et al. | 428/323 |
| 5,708,943 | A | 1/1998 | Applegate et al. | 399/284 |
| 5,797,076 | A | 8/1998 | Bracken et al. | 399/284 |
| 5,809,386 | A * | 9/1998 | Iwata | 399/281 |
| 5,853,868 | A | 12/1998 | Bracken et al. | 428/323 |
| 5,913,626 | A | 6/1999 | Ishida et al. | 400/625 |
| 6,021,297 | A | 2/2000 | Campbell et al. | 399/284 |
| 6,027,266 | A | 2/2000 | Turner | 400/208 |
| 6,049,689 | A * | 4/2000 | Ishii et al. | 399/284 |
| 6,078,771 | A | 6/2000 | Buchanan et al. | 399/284 |
| 6,183,079 | B1 | 2/2001 | Meade et al. | 347/101 |
| 6,232,994 | B1 | 5/2001 | Wiklof | 347/177 |
| 6,397,026 | B1 | 5/2002 | Buxton et al. | 399/111 |
| 6,510,291 | B2 | 1/2003 | Campbell et al. | 399/27 |
| 6,678,489 | B1 | 1/2004 | Carter et al. | 399/113 |
| 6,697,594 | B1 | 2/2004 | Murphy et al. | 399/284 |
| 6,706,118 | B2 | 3/2004 | Heink et al. | 118/697 |
| 6,741,829 | B2 | 5/2004 | Stickler et al. | 399/351 |
| 6,771,922 | B2 | 8/2004 | Blanck et al. | 399/260 |
| 6,816,692 | B1 | 11/2004 | Kerley et al. | 399/222 |
| 2002/0154916 | A1 | 10/2002 | Stirling et al. | 399/27 |
| 2005/0074262 | A1 * | 4/2005 | Kamimura | 399/284 |

FOREIGN PATENT DOCUMENTS

JP 07281527 A * 10/1995

* cited by examiner

*Primary Examiner*—Quana Grainger
(74) *Attorney, Agent, or Firm*—Coats & Bennett, PLLC

(57) ABSTRACT

A toner cartridge for an image forming apparatus, the cartridge having: a housing defining a toner reservoir; a developer roller supported by the housing; a doctor blade supported by the housing and positioned adjacent the developer roller; and a retainer connected to the housing and positioned over a side of the doctor blade opposite the reservoir.

14 Claims, 6 Drawing Sheets

METHOD AND DEVICE FOR DOCTOR BLADE RETENTION

FIELD OF THE INVENTION

This invention, according to one embodiment, relates to image forming equipment, including, e.g., copiers, printers, facsimile machines and/or the like. In particular, this invention, according to an embodiment, relates to methods and devices for positioning a doctor blade against a developer roller and may prevent and/or reduce toner loss.

BACKGROUND OF THE INVENTION

Image forming devices including copiers, laser printers, facsimile machines, and the like, include a photo conductive drum (hereinafter "photoconductor") having a rigid cylindrical surface that is coated along a defined length of its outer surface. The surface of the photoconductor is typically charged to a uniform electrical potential and then selectively exposed to light in a pattern corresponding to an original image. The areas of the photoconductive surface exposed to light are discharged, thus forming a latent electrostatic image on the photoconductive surface. A developer material, such as toner, having an electrical charge such that the toner is attracted to the photoconductive surface is used for forming the image. The toner is normally stored in a reservoir adjacent to the photoconductor and is transferred to the photoconductor by the developer roll. The thickness of the toner layer on the developer roll may be controlled by a nip, which is typically formed between a doctor blade and the developer roll. A recording sheet, such as a blank sheet of paper, may then be brought into contact with the discharged photoconductive surface and the toner therein is transferred to the recording sheet in the form of the latent electrostatic image. The recording sheet may then be heated thereby permanently fusing the toner to the sheet. In preparation for the next image forming cycle, the photoconductive surface may be discharged and residual toner removed.

FIGS. 1 and 2 illustrate typical toner housings. Developer roller 4, doctor blade 5, and toner reservoir 6 may be supported and held together by a toner cartridge housing 2. Housing 2 may be made of plastic, molded parts and may be configured to retain the internal components. In particular, housing 2 may support doctor blade 5 in, e.g., close contact with developer roller 4, and may provide a nip point that may apply a uniform layer of toner to the drum. Some toner housings 2 may also support a doctor blade spring 7 that may bias doctor blade 5 toward developer roller 4.

As shown in FIGS. 1 and 2, typical toner cartridge housings may also have a stop post 12 positioned above doctor blade 5 opposite developer roller 4. Stop post 12 may function to control the maximum movement of doctor blade 5 away from developer roller 4. Stop posts may function to ensure safety during handling of the cartridge 1, e.g., they may keep the doctor blade within the cartridge. By way of example, if the cartridge is dropped, the stop post may prevent the doctor blade from separating from the housing and possibly damaging the cartridge, image forming apparatus, or injuring a person handling the equipment.

Typical toner housings may also have a retention post 14 and a retention block 16. Retention posts 14 and retention blocks 16 may function to maintain doctor blade 5 in the proper orientation with the doctor blade lower edge positioned against developer roller 4. The post and block may work in combination and the doctor blade may contact only one or both during the toner transfer process. They may also function to effectively control the positioning of the doctor blade without causing friction with the doctor blade that may restrict the movement of the doctor blade to and from the developer roller. Stop posts, retention posts, and retention blocks may be constructed as a unitary piece having a common back section 18. (See FIG. 1).

SUMMARY OF THE INVENTION

This invention, according to one embodiment, relates to image forming equipment, including, e.g., copiers, printers, facsimile machines and/or the like. In particular, this invention, according to an embodiment, relates to methods and devices for positioning a doctor blade against a developer roller while, e.g., reducing and/or preventing toner loss.

According to one embodiment of the invention, there may be provided a method for providing toner to an image forming apparatus, said method may have the following steps: applying toner from a reservoir to a developer roller; regulating the amount of toner applied to the developer roller with a doctor blade; and covering the doctor blade with a cover opposite the reservoir to retain toner.

A further embodiment of the invention provides a toner cartridge for an image forming apparatus, the cartridge may have: a housing defining a toner reservoir; a developer roller supported by the housing; a doctor blade supported by the housing and positioned adjacent the developer roller; and a retainer connected to the housing and positioned over a side of the doctor blade opposite the reservoir.

Still another embodiment of the invention, may provide a system for supporting a doctor blade, the system having: a retainer connectable to a toner cartridge housing at a position adjacent to a doctor blade opposite a toner reservoir; and a flange may extend from the retainer and engage the doctor blade.

According to a still further embodiment of the invention, there may be provided a toner cartridge for an image forming apparatus, the cartridge having: a housing defining a toner reservoir; a developer roller supported by the housing; a doctor blade supported by the housing and positioned adjacent to the developer roller; and a means for retaining toner escaping from between the developer roller and the doctor blade.

BRIEF DESCRIPTION OF THE FIGURES

Some embodiments of the present invention may be better understood by reading the following description of non-limitative embodiments with reference to the attached drawings wherein like parts of each of the several figures are identified by the same referenced characters, and which are briefly described as follows.

It is to be noted, however, that the appended drawings illustrate only typical embodiments of this invention and are therefore not to be considered limiting of its scope, as the invention may admit to other equally effective embodiments.

DETAILED DESCRIPTION OF EMBODIMENTS OF THE INVENTION

Figure 1:
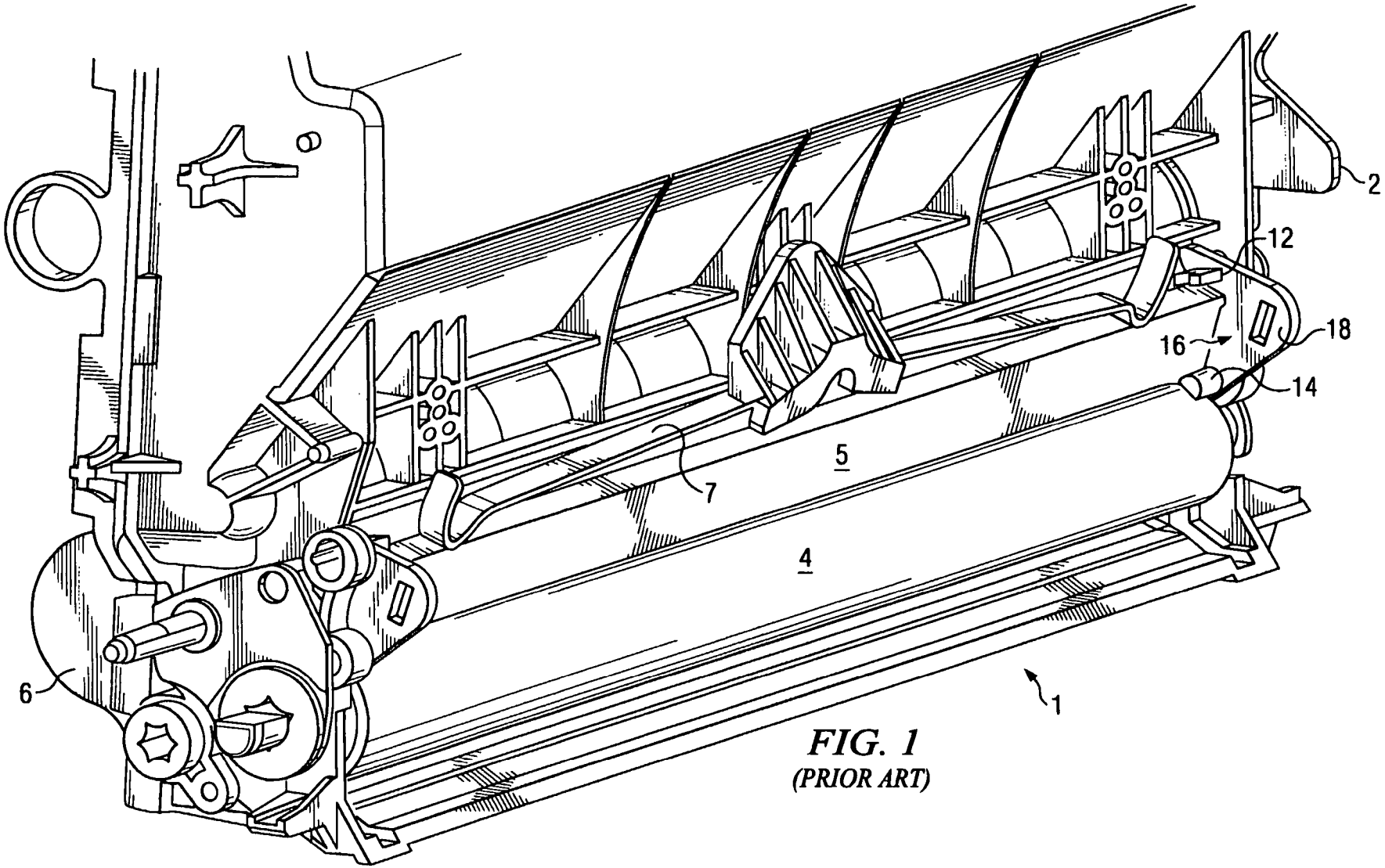
FIG. 1 (PRIOR ART)
FIG. 1 is a perspective view of a prior art toner cartridge having a developer roller and a doctor blade.
Figure 2:
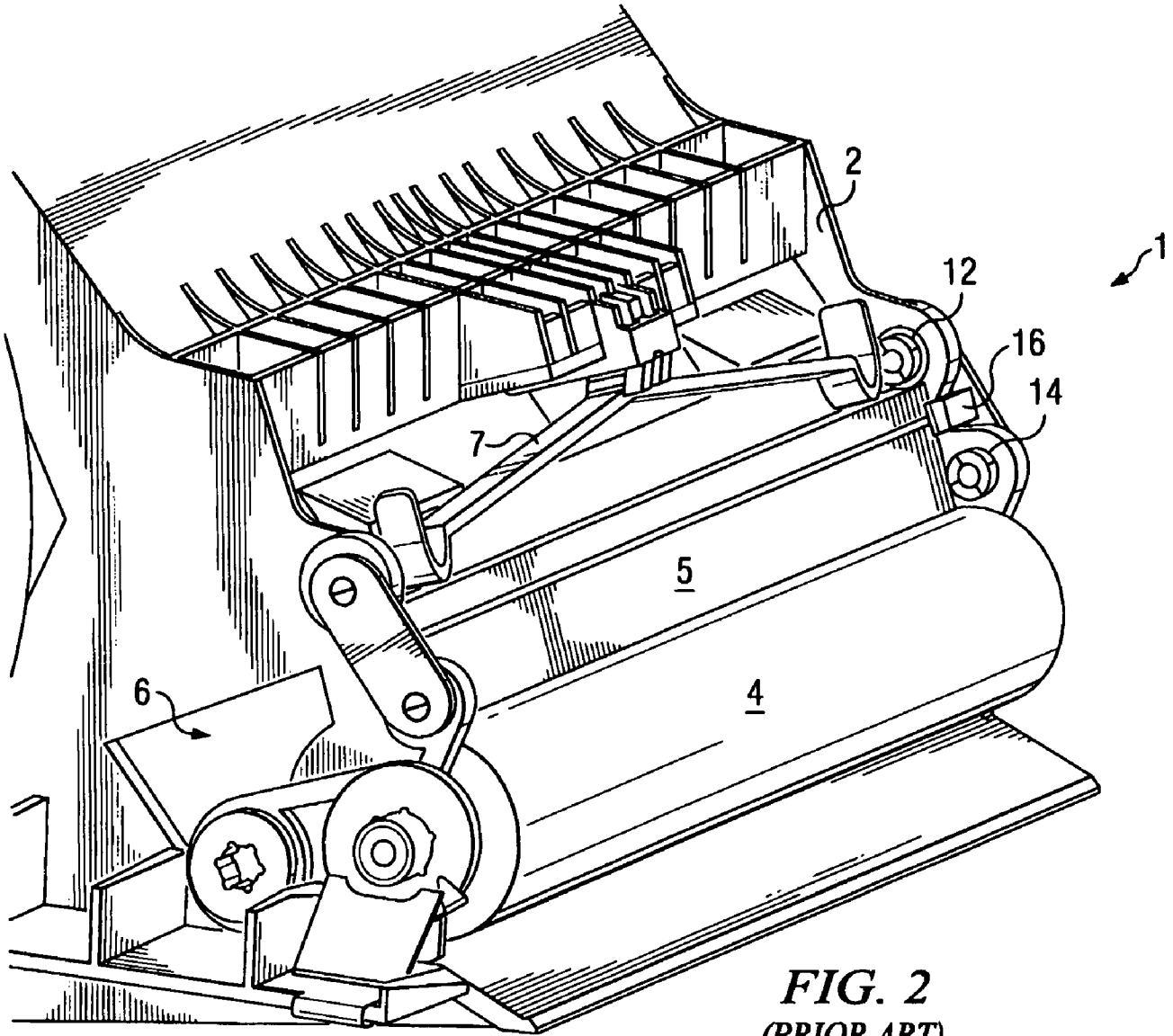
FIG. 2 (PRIOR ART)
FIG. 2 is a perspective view of a prior art toner cartridge having a developer roller and a doctor blade.
Figure 3:
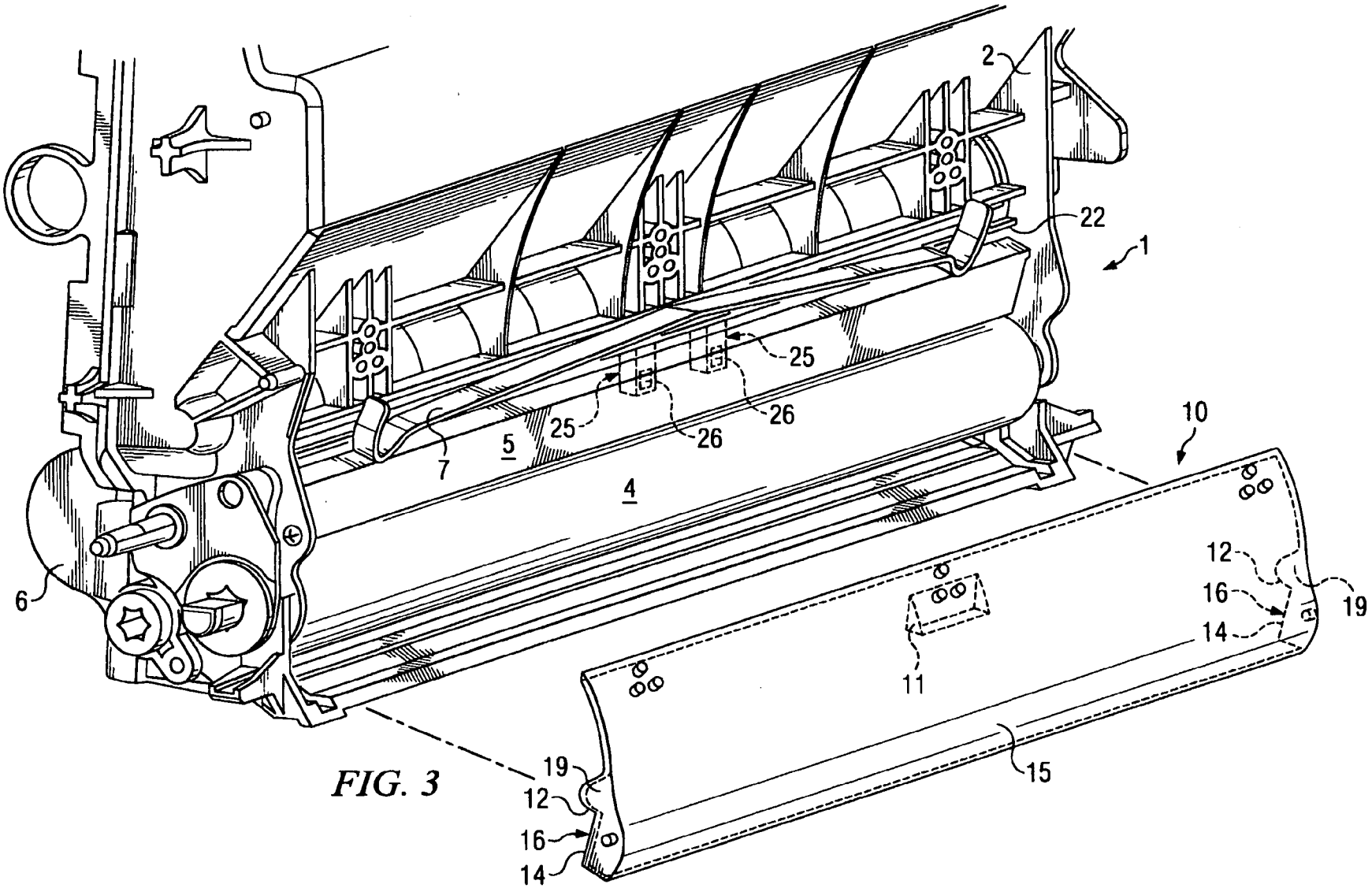
FIG. 3 is an expanded, perspective view of a toner cartridge according to an embodiment of the invention having a retainer.

Referring to FIG. 3, a perspective view of a toner cartridge is illustrated. Toner cartridge 1 may have a housing 2 that supports a developer roller 4 and a doctor blade 5. A toner reservoir 6 may be retained within housing 2 behind developer roller 4. A doctor blade spring 7 may be positioned above doctor blade 5 to, e.g., bias doctor blade 5 toward developer roller 4. Toner cartridge 1 may also have a retainer 10 that mates with housing 2. Retainer 10 may have two flanges 19 that may extend from retainer 10 toward housing 2. Each flange 19 may have a stop post 12, and may have two retention points, e.g., a retention post 14 and a retention block 16. Retention post 14 may be located at the lower most end of the flange 19 below the stop post 12. And the retention block 16 may be positioned between the stop post 12 and the retention post 14.

In the illustrated embodiment, retainer 10 may also have a cover 15 that may, e.g., extend the entire length of retainer 10 to fully or partially enclose doctor blade 5 and optionally, doctor blade spring 7. Cover 15 may prevent and/or reduce toner from collecting on the external surfaces of the toner unit and may minimize the user's exposure to toner. Retainer 10 may retain doctor blade 5 in housing 2. According to certain embodiments of the present invention, retainer 10 may also retain doctor blade spring 7 in housing 2 with, e.g., a spring cleat 11. According to certain embodiments of the present invention, retainer 10, cover 15, spring cleat 11, stop post 12, retention post 14, and retention block 16 may be formed as a unitary piece. Further, according to certain embodiments of the invention, cover 15 may visually block doctor blade 5 and optionally, doctor blade spring 7 from the user's view, e.g., to provide a more integrated appearance to housing 2. In certain embodiments, cover 15 may only enclose a portion of the doctor blade 5 and/or doctor blade spring 7.

According to an embodiment of the invention, in the middle of retainer 10, a spring cleat 11 may be fixed to cover 15. Spring cleat 11 may engage and may support doctor blade spring 7 and, e.g., push doctor blade spring 7 toward doctor blade 5. If retainer 10 is attached to housing 2, doctor blade spring 7 may be supported by spring cleat 11, e.g., above doctor blade 5 to, e.g., maintain a force to bias a lower edge of doctor blade 5 against developer roller 4. The drawings illustrate doctor blade 5 substantially perpendicular to developer roller 4, however, other orientations may also provide for transfer of desired toner amounts. Doctor blade spring 7 may contact doctor blade 5 at more than one location along the doctor blade 5 to, e.g., ensure that an even and distributed force may be applied across the entire width of developer roller 4.

Retainer 10 may have a plurality of holes 13 through which fasteners may extend to secure retainer 10 to housing 2. In particular, the fasteners may be screws, rivets, guide posts or any other fastener means known to skilled persons. Housing 2 and retainer 10 may be constructed of polystyrene, or any other material known to skilled persons.

FIG. 3 also illustrates that housing 2 may have a pair of extensions 25 mounted on a housing support 22 of housing 2. In the illustrated embodiment, extensions 25 may be equally spaced from a centerline of housing 2. According to certain embodiments, the distance between extensions 25 may vary depending upon the parameters of the toner cartridge. According to one embodiment, the extensions may be separated by about 25 mm, but other separation distances may be utilized. Extensions 25 may have a variety of shapes and sizes. According to an embodiment of the invention, extensions 25 may be substantially rectangular in shape and may have a width of about 5 mm and may have a thickness of about 1.5 mm. According to another embodiment of the invention, a stiffening rib may extend between housing support 22 and a back of extensions 25 and may, e.g., provide additional stiffness and/or strength. According to certain embodiments of the invention, a shoulder may extend outward from the face of extensions 25 to support a dampener 26, or the dampener 26 may be adhered to the face. According to an embodiment of the invention, both extensions 25 may have the same shape, size and dimensions to equally support doctor blade 5. Any number of extensions, including a single one, may be used to support doctor blade 5.

According to an embodiment of the invention, dampeners 26 may be provided and may have a damping capacity to absorb vibrations from doctor blade 5. According to one embodiment of the invention, dampeners 26 may be constructed of a resilient material that may be compressed by doctor blade 5 and may apply a force to doctor blade 5. In relation to one embodiment of the invention, dampeners 26 may be constructed of PORON foam, a polyurethane foam commercially available from Rogers Corp. as 4790-92-2008104. According to an embodiment of the invention, only one extension includes a dampener 26.

According to an embodiment of the invention, dampeners 26 may have a thickness such that doctor blade 121 contacts dampeners 26 on a first side and a retention block 16 on the opposite side. According to one embodiment of the invention, dampeners 26 may be about 2.0 mm thick. Dampeners 26 may have a variety of shapes and sizes. According to an embodiment, dampeners 26 may be positioned on the front of the extensions 25 and may rest on a shoulder adjacent to a bottom edge of the extensions 25. According to another embodiment, dampeners 26 may have a width of about 5.0 mm. In one embodiment, dampeners 26 may be attached to extensions 25 by an adhesive that may be applied in a variety of manners. According to an embodiment, the adhesive comprises a pressure sensitive material applied to one side of dampeners 26 facing extensions 25. In relation to one embodiment of the invention, the adhesive may be Model No. 7953 manufactured by 3M. Extensions 25 may include a knurled surface to improve the adhesion of the adhesive.

According to certain embodiments of the invention dampeners 26 may be applied to retention posts 14 and/or retention blocks 16 in addition to being applied to extensions 25 or instead of being applied to extensions 25. Doctor blade 5 may also be squeezed slightly between extensions 25 and retention posts 14 and/or retention blocks 16 by adjusting the positions of the support structures relative to the thickness of doctor blade 5.

Figure 4:
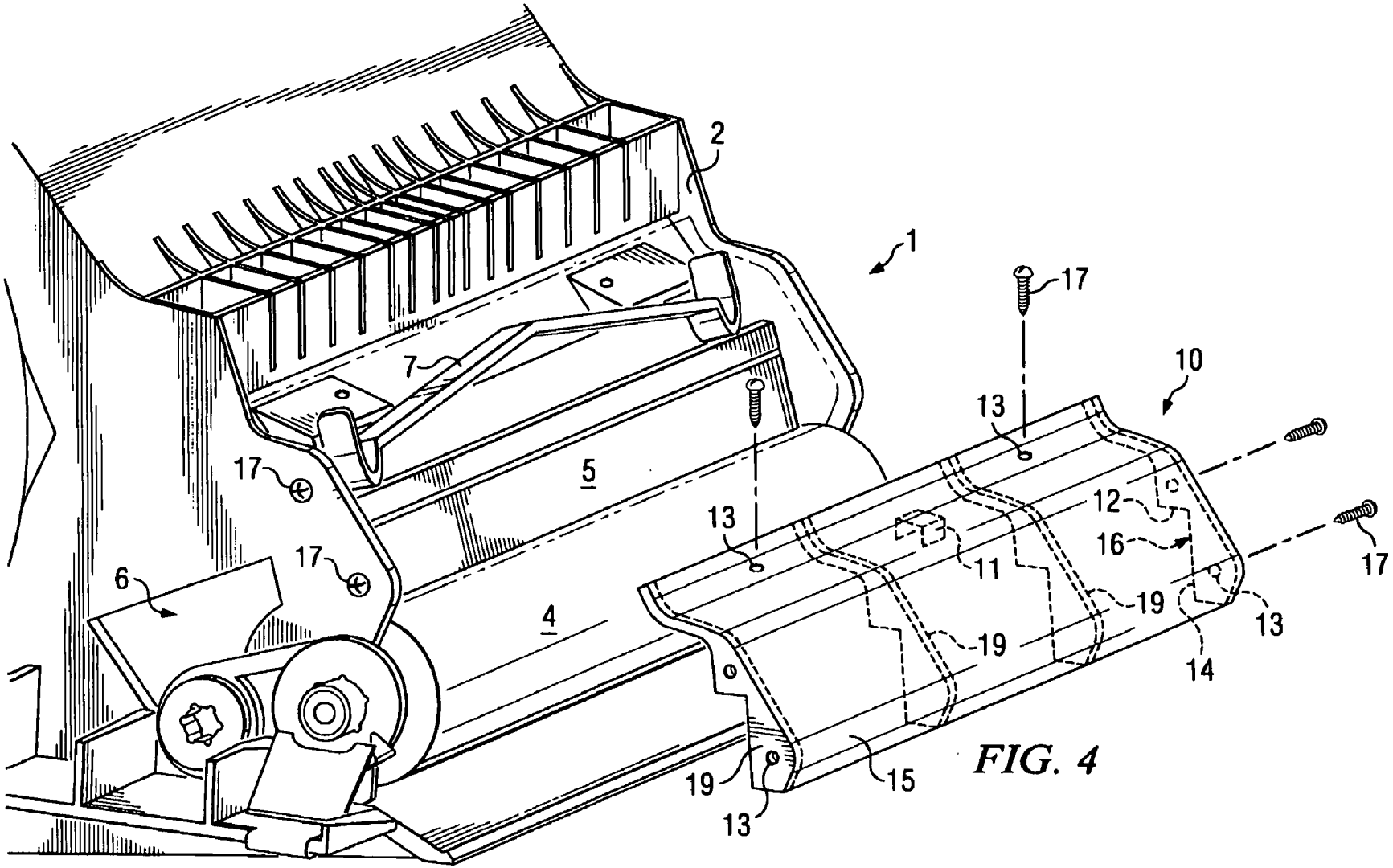
FIG. 4 is an expanded, perspective view of a toner cartridge according to an embodiment of the invention having a retainer.

Referring to FIG. 4, a perspective view of a toner cartridge 1, according to one embodiment of the invention, is illustrated. Toner cartridge 1 may have a housing 2 and a retainer 10. Housing 2 may have contained within (i) a developer roller 4, (ii) a doctor blade 5 and (iii) a toner reservoir 6. Retainer 10 may have a cover 15 that may extend the entire length of retainer 10. Cover 15 may be contoured to fit over doctor blade 5 and optionally, doctor blade spring 7 and, e.g., may mate with housing 2. Retainer 10 may also have four flanges 19 that may protrude from cover 15 toward, e.g., housing 2. While four flanges are illustrated, according to certain embodiments of the invention, any number of flanges may be used.

According to further embodiments of the invention, a uniform structure having a profile shaped like the illustrated flanges may extend across the entire length of retainer 10, e.g., to support doctor blade 5 at all points. As illustrated, each of flanges 19 has a stop post 12, a retention post 14, and a retention block 16. Retainer 10 may also have a spring cleat 11 to, for example, engage doctor blade spring 7. Retainer 10 may be attached to housing 2, and doctor blade spring 7 may reside within spring cleat 11, e.g., so that spring cleat 11 may press doctor blade spring 7 against doctor blade 5.

According to other certain embodiments of the invention, retainer 10 may be attached to housing 2 with, e.g., fasteners, like fasteners 17. Any number of fasteners may be used. The fasteners may extend through holes 13 in cover 15 of retainer 10 and/or through holes 13 in flanges 19. If retainer 10 is attached to housing 2, cover 15 may help reduce or prevent toner from escaping from the toner cartridge 1, e.g., when the toner cartridge is dropped or otherwise mishandled.

Figure 5:
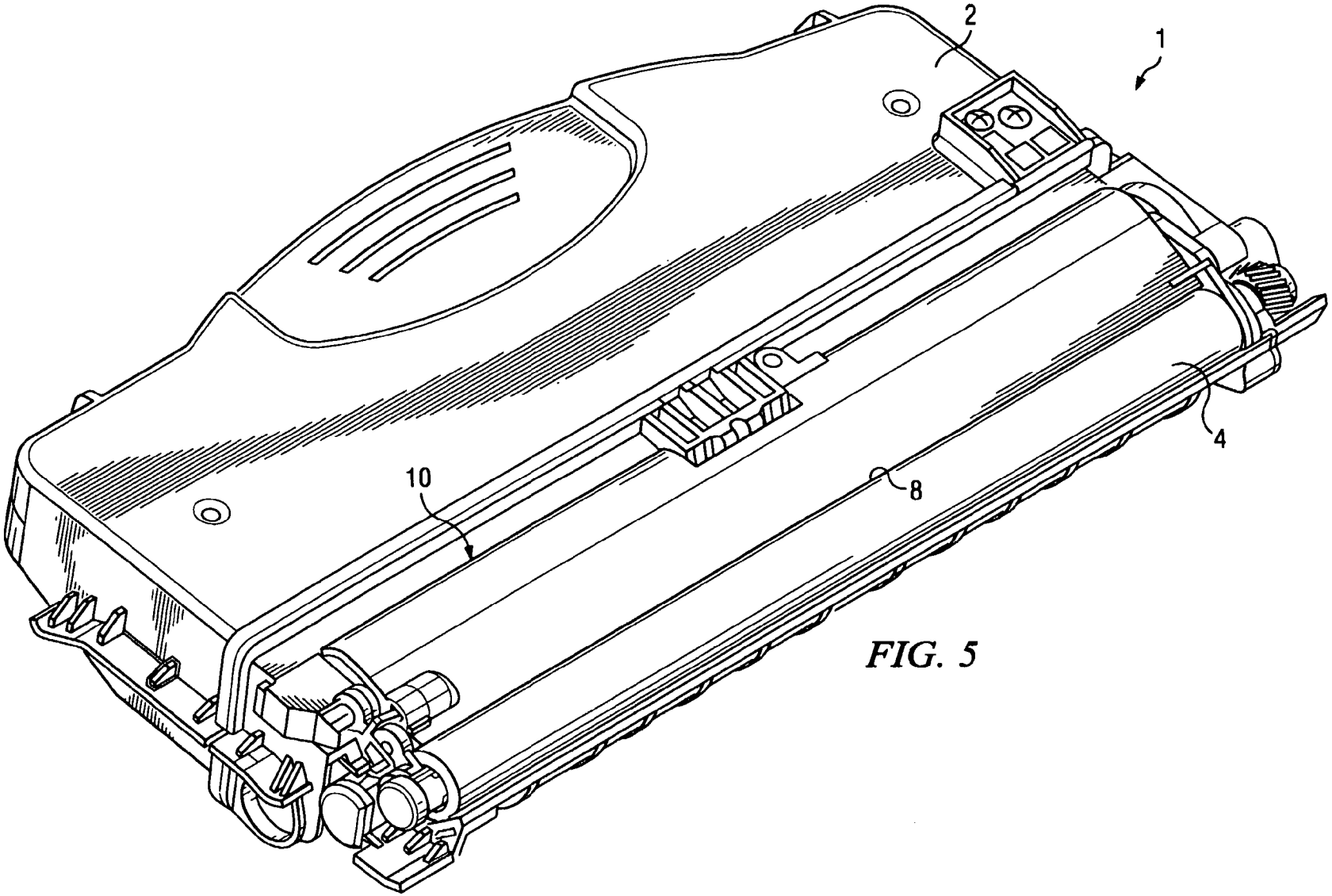
FIG. 5 is a perspective view of a toner cartridge according to an embodiment of the invention having a retainer.

Referring to FIG. 5, a perspective view of a toner cartridge according to an embodiment of the invention is illustrated. In particular, toner cartridge 1 comprises housing 2 and retainer 10. Retainer 10 may be attached to housing 2 to partially and/or completely cover a doctor blade and optionally, doctor blade spring. According to certain embodiments of the invention, a small gap 8 may remain between retainer 10 and developer roller 4. According to other embodiments of the invention, gap 8 may be small enough to prevent or reduce excess toner from freely escaping from toner cartridge 1 and/or large enough so as not to interfere with charged toner properly adhering to developer roller 4.

Figure 6:
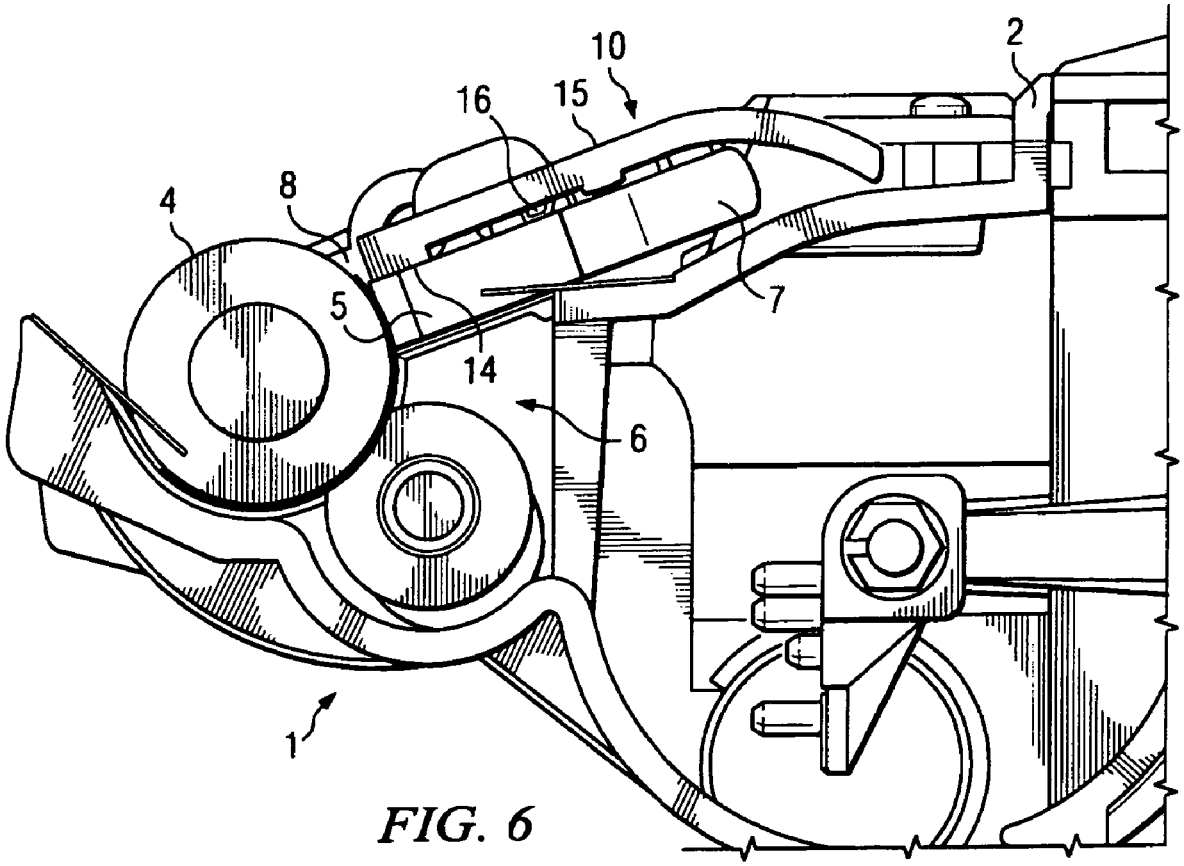
FIG. 6 is a cross-sectional, side view of a toner cartridge according to an embodiment of the invention having a retainer.

Referring to FIG. 6, a cross-sectional side view of a toner cartridge according to an embodiment of the invention is illustrated. Toner cartridge 1 may have housing 2 and retainer 10. Housing 2 may support developer roller 4, doctor blade 5, and/or toner reservoir 6. Retainer 10 may also support doctor blade spring 7. According to an embodiment, retainer 10 may also have a retention post 14 and a retention block 16 which may engage doctor blade 5. Retainer 10 may also have a cover 15 extending partially and/or completely over doctor blade 5 and optionally, doctor blade spring 7. Retention post 14 and retention block 16 may extend from cover 15 toward doctor blade 5. Retention post 14 and retention block 16 may extend across the entire length of doctor blade 5. However, according to alternative embodiments of the invention, the retention posts may only engage doctor blade 5 at a certain point or points across its length. Retainer 10 may be attached to housing 2 and may form a gap 8 between a lower edge of retainer 10 and developer roller 4.

According to certain embodiments of the invention, a seal (not shown) may be positioned where doctor blade 5 contacts the inner side wall of housing 2 and may ensure toner does not leak between these elements and/or substantially reduces the amount of leaked toner. The seal may be a polyester film or O-ring seal; however, other seal materials may also be utilized. A flap seal (not shown) may also extend along the back side of doctor blade 5 and may prevent or reduce the leaking of toner from toner reservoir 6 to developer roller 4, that might ultimately escape the toner cartridge. The flap seal may be positioned against a back edge of doctor blade 5, but may not be attached if the inhibition of the relative mobility of the doctor blade 5 is not desired. The material of the flap seal may provide a low to approximately zero friction contact with doctor blade 5. According to certain embodiments of the invention, the flap seal may be constructed of a polyester film such as that sold under the trademark Mylar by DuPont. However, other low friction materials may also be used.

While the invention has been depicted and described with reference to embodiments of the invention, such a reference does not imply a limitation on the invention, and no such limitation is to be inferred. The invention is capable of considerable modification, alteration, and equivalents in form and function, as will occur to those ordinarily skilled in the pertinent arts having the benefit of this disclosure. The depicted and described embodiments of the invention are examples only, and are not exhaustive of the scope of the invention. Consequently, the invention is intended to be limited only by the scope of the appended claims, giving full cognizance to equivalents in all respects.

What is claimed is:

1. A toner cartridge for an image forming apparatus, the cartridge comprising:
   - a housing defining a toner reservoir;
   - a developer roller supported by the housing;
   - a doctor blade supported by the housing and positioned adjacent the developer roller; and
   - a retainer connected to the housing and positioned over a side of the doctor blade opposite the reservoir;
   - wherein the cartridge further comprises a doctor blade spring, wherein the retainer comprises a spring cleat that supports the doctor blade spring.

2. A toner cartridge for an image forming apparatus as claimed in claim 1, wherein the retainer comprises at least one flange extending toward the doctor blade.

3. A toner cartridge for an image forming apparatus as claimed in claim 1, wherein the retainer comprises a stop post positioned adjacent the doctor blade opposite the developer roller.

4. A toner cartridge for an image forming apparatus as claimed in claim 1, wherein the retainer comprises a retention post positioned adjacent to a side of the doctor blade.

5. A toner cartridge for an image forming apparatus as in claim 1, wherein the retainer comprises a retention block positioned adjacent to a side of the doctor blade.

6. A toner cartridge for an image forming apparatus as claimed in claim 1, wherein the retainer comprises a flange extending toward the doctor blade, wherein the flange comprises a stop post, a retention post, and a retention block.

7. A toner cartridge for an image forming apparatus as claimed in claim 1, wherein the retainer comprises a cover that extends over more than half of the doctor blade.

8. A toner cartridge for an image forming apparatus as claimed in claim 1, wherein the cartridge further comprises an extension from the housing that supports the doctor blade on a side of the doctor blade facing the reservoir.

9. A toner cartridge for an image forming apparatus as claimed in claim 1, further comprising an extension from the housing that supports the doctor blade on a side of the doctor blade facing the reservoir, and wherein the retainer comprises a retention post and is positioned such that the doctor blade is between the extension and the retention post.

10. A toner cartridge for an image forming apparatus as claimed in claim 1, wherein the cartridge further comprises a dampener attached to the retainer and positioned to contact the doctor blade.

11. A system for supporting a doctor blade, the system comprising:

a retainer connectable to a toner cartridge housing at a position adjacent to a doctor blade opposite a toner reservoir;

a flange with a stop post that extends from the retainer and engages the doctor blade; and a cover of the doctor blade for retaining toner.

12. A system for supporting a doctor blade as claimed in claim 11, wherein the flange includes a retention roost, the flange and the retention post each extending from the retainer and engaging the doctor blade.

13. A system for supporting a doctor blade as claimed in claim 11, further comprising a spring cleat that supports a doctor blade spring.

14. A system for supporting a doctor blade as claimed in claim 11, further comprising a dampener attached to the retainer and positioned to contact the doctor blade.

* * * * *